US007661547B2

(12) United States Patent
Richir

(10) Patent No.: US 7,661,547 B2
(45) Date of Patent: Feb. 16, 2010

(54) CLOSURE CAP FOR A CONTAINER

(75) Inventor: Franck Richir, Chateau-Thierry (FR)

(73) Assignee: Airsec S.A.S., Choisy le Roi (FR)

( * ) Notice: Subject to any disclaimer, the term of this patent is extended or adjusted under 35 U.S.C. 154(b) by 392 days.

(21) Appl. No.: 11/432,198

(22) Filed: May 11, 2006

(65) Prior Publication Data

US 2007/0262044 A1 Nov. 15, 2007

(30) Foreign Application Priority Data

May 12, 2005 (EP) ..... 05010357

(51) Int. Cl.
*B65D 55/10* (2006.01)
*B65D 43/22* (2006.01)

(52) U.S. Cl. ..... 215/225; 215/216; 215/244; 215/901; 220/324; 220/326; 220/833

(58) Field of Classification Search ..... 215/225, 215/216, 901, 244; 220/324, 326, 833
See application file for complete search history.

(56) References Cited

U.S. PATENT DOCUMENTS 3,828,969 A * 8/1974 Schurman ..... 220/324
4,453,648 A * 6/1984 Harris et al. ..... 220/324
4,610,371 A * 9/1986 Karkiewicz ..... 220/266
4,774,973 A * 10/1988 Gueret ..... 220/326
4,892,208 A * 1/1990 Sledge ..... 215/216
4,952,160 A * 8/1990 Olsen ..... 439/142
5,156,293 A * 10/1992 Petterson et al. ..... 220/326
5,272,832 A * 12/1993 Marshall et al. ..... 43/131
5,353,946 A * 10/1994 Behrend ..... 220/326
5,497,906 A 3/1996 Dubach
5,520,301 A * 5/1996 Sohn ..... 220/265
5,685,444 A 11/1997 Valley
5,788,105 A 8/1998 Foos
6,669,047 B2 * 12/2003 Wooderson et al. ..... 220/316
6,779,681 B2 * 8/2004 Doerfler et al. ..... 220/835
6,866,442 B1 * 3/2005 Petersen ..... 403/326
6,877,631 B1 * 4/2005 Thompson et al. ..... 220/266
7,197,831 B2 * 4/2007 Nepil ..... 33/414
2004/0065669 A1 * 4/2004 Giraud et al. ..... 220/839

FOREIGN PATENT DOCUMENTS

EP 147507 A2 7/1985

* cited by examiner

*Primary Examiner*—Anthony Stashick
*Assistant Examiner*—Niki M Eloshway
(74) *Attorney, Agent, or Firm*—John C. Thompson; Sandra J. Thompson

(57) ABSTRACT

The present invention relates to a closure cap for a container, with a hinge and a lid which is intended to be tightened to the rim of a container body, and with a closure element which is movable to a temper-evident position. The closure element 34 is attached to the closure cap 14 and movable to an intermediate position in which the closure cap 14 seals against the rim 18 of the container body 12. Additionally, the closure element 34 is movable from the intermediate position to the temper-evident position in a single stroke.

3 Claims, 5 Drawing Sheets

CLOSURE CAP FOR A CONTAINER

CROSS REFERENCE TO RELATED APPLICATIONS

This application claims foreign priority benefits under 35 U.S.C. §119 (a)-(d) from European patent application ser. no. 05010357.1 filed on May 12, 2005.

TECHNICAL FIELD

The present invention refers to a closure cap for a container according to the opening portion of claim 1, and to a corresponding container.

BACKGROUND OF THE INVENTION

Such containers are widely known, such as from EP-A2-147 507. Such containers are intended to keep goods moisture-free, and usually a suitable absorbant material is provided in the lid or cover of the container to maintain a moisture-free environment for the goods such as drugs, during a long time.

The lid is provided with a seal sealing the container body such that no environment moisture may enter the interior of the container.

On the other hand, every time the cover or lid is opened, environment moisture may enter the container. Thus, it is essential to ensure that the container is not inadvertently opened. An example of such a temper-evident cap and a suitable container is known from the above mentioned EP-A2-147 507. The rim of the cover is provided with a temper-evident safety ring, and to open the cap would break webs provided between the safety ring and the cap border.

A considerable number of other safety elements and temper-evident caps has been proposed in the meantime. On the other hand, the containers are usually made of plastic and are manufactured at sites far from the manufacture of drugs or other goods which are to be kept in the container. The manufacturer of the containers supplies the manufacturer of the goods with the containers in its open position. The container should then be filled, supplied with a capsule with desiccant or absorbant material and closed. This is a time-consuming and expensive operation which has to be done diligently.

On the other hand, recently containers with integral desiccant inserts have been developed, and if such a container is trans-ported to the site where it is to be filled with the moisture-sensitive goods, it has to be kept closed without risking the break of the safety element. This is rather complicated, and usually the containers are collected and transported in a large package which itself is moisture-sealed.

OBJECTS AND SUMMARY OF THE INVENTION

Thus, it is an object of the present invention to provide a closure cap for a container, according to the opening portion of claim 1, and a corresponding container, which allows a better handling when filling the container with moisture-sensitive goods.

This object is settled by the claims 1 and 11. Advantageous developments may be taken from the subclaims.

With the present invention, it is advantageously and easily possible to pre-close the container, with the absorbant material already contained in the container. The container is tight in this position, and yet the safety element is not torn if it is re-opened by the manufacturer of the goods, in order to fill the container with the desired goods.

The container according to the invention has the significant advantage that containers may be completely manufactured by the manufacturer of plastic containers etc, and no further step beyond plain packaging is required at the site of the drug manufacturer. Yet the container may be provided with desiccant material, and the desiccant material is safely kept dry during transport. Also, the container according to the invention is provided with a safety element and thus has a temper-evident cap which allows to safely recognize any unintentional or intentional opening of the container before use. Thus, as long as the safety element is in its untorn state, the user or customer may rely on the safe drying operation of the desiccant material which is used.

Advantageously, the inventive safety element is easy to manufacture and may be brought into its active, i.e. temper-evident position, just by a single step such as pushing it down. This step can easily be achieved by machine operation i.e. by the packaging machine itself.

In an advantageous development, the safety element or closure element according to the invention is torn into two pieces, and one piece, preferably the upper piece, is free and unattached from both the container body and the container cap. Thus, this upper piece will get out of its original position and the break of the safety element is easily visible. Preferably, the safety element has a signal color such as red such that the user will immediately recognize if the safety element gets lost.

Further details, advantages and features may be taken from the following description of the preferred embodiments of the invention with reference to the drawings.

DETAILED DESCRIPTION

Figure 1:
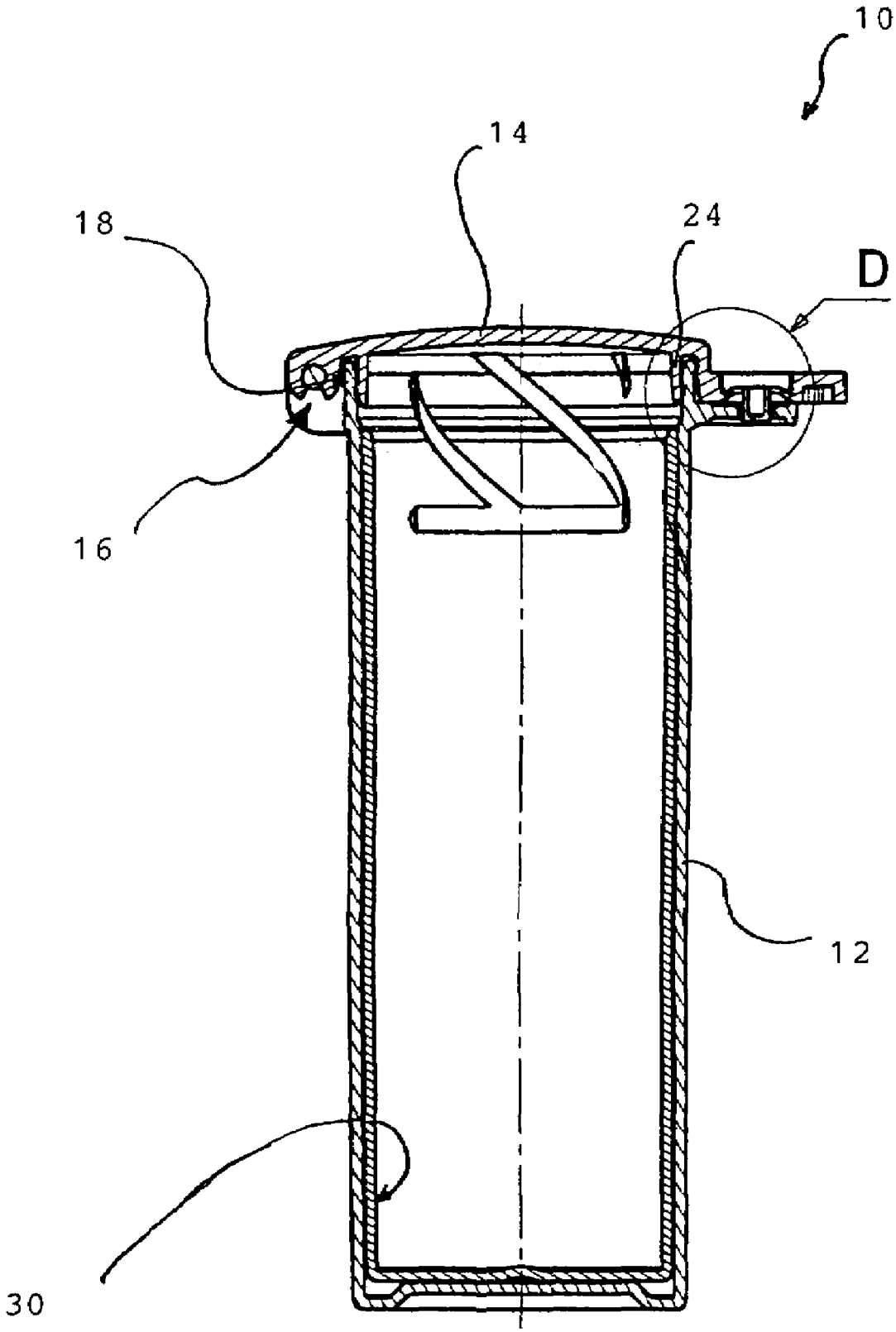
FIG. 1 a sectional view of a first embodiment of the container with the closing cap according to the invention.

FIG. 1 shows a sectional view of the container 10 according to the invention. The container 10 comprises a container body 12 and a container cap 14 which are interconnected with each other via a hinge 16. In the embodiments shown in FIG. 1 hinge 16 is a snap-fit hinge, and the container body 12 is cup-shaped and has an overall cylindrical form. The upper edge or rim 18 of the container body 12 is provided with a sealing groove 20 which can be seen from the enlarged view of FIG. 2 and which interacts with a protrusion 22 which is arranged on a ring 24 integrally mounted on cap 14. Thus, the cap 14 and the container body 12 are sealed from each other in a well-known manner.

In the present embodiment, the container body 12 is provided with desiccant material 30 which is arranged on the inner circumference and the bottom of container body 12. A spiral body extends from the cap 14 downwards in order to hold the goods to be received in the container body 12 in position.

The container 10 according to the invention is provided with a special closure element which is described with reference to FIG. 2.

Figure 2:
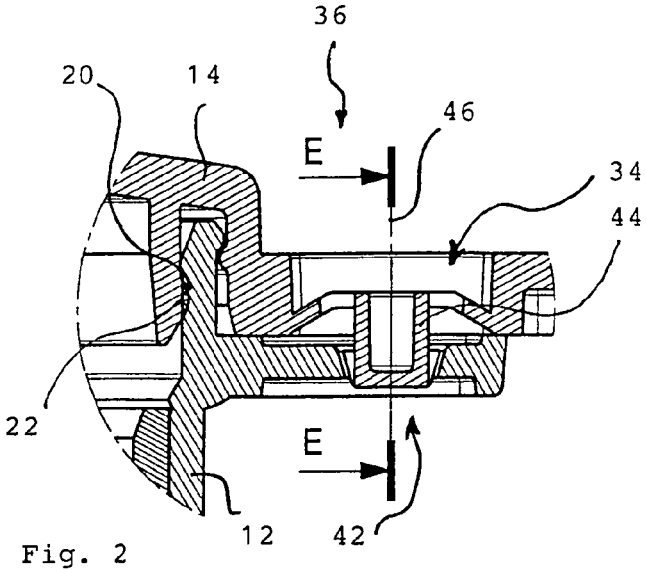
FIG. 2 a sectional view of part D of FIG. 1.

FIG. 2 shows a closure element 34 which is mounted in a recess 36 of the cap 14. The closure element 36, in this embodiment, is integrally formed together with cap 14 and is mounted via two webs 38 and 40 which may be taken from FIG. 4. It is intended to be inserted into an opening 42 which is provided laterally of the container body 12. The closure element 34, at its cylindrical portion 44, is provided with wedge-shaped protrusions 48 and may be pressed downwards along its axis 46. The opening 42 has a conical shape, following the wedge-shaped protrusions 48. If a sufficient pressure is exerted from above to below along axis 46, the cylindrical portion 44 will snap into the opening 42 and the wedge-shaped protrusions 48 will prevent the cylindrical portion 44 from being withdrawn again. The webs 38 and 40 bias the closure element 34 to the position shown in FIG. 2.

Figure 3:
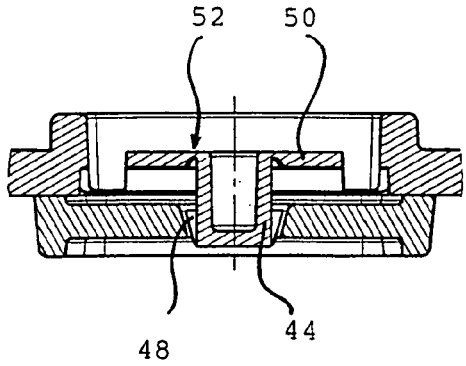
FIG. 3 a sectional view of the safety element, taken along the line EE of FIG. 2.

FIG. 3 shows a view of the closure element 34 but in another direction than FIG. 2. As may be taken from FIG. 3, the closure element 34 comprises the cylindrical portion 44 and a flat portion 50. Both portions are interconnected with each other via a film hinge 52 which is formed as a very thin connection which easily tears if force is exerted.

If the cylindrical portion 44 and the closure element 46 is in the temper-evident position where the wedge-shaped protrusions 48 are snapped into opening 42, there is no other way to release this portion than to destroy film hinge 52 which is done when the container 10 is opened. Even if the container 10 is closed again, the flat portion 50 will remain in the intermediate position shown in FIGS. 2 and 3 while the cylindrical portion 44 will stay in the temper-evident position. Thus any user may take notice that the container 10 has been tempered or unintentionally opened in the meantime.

Figure 4:
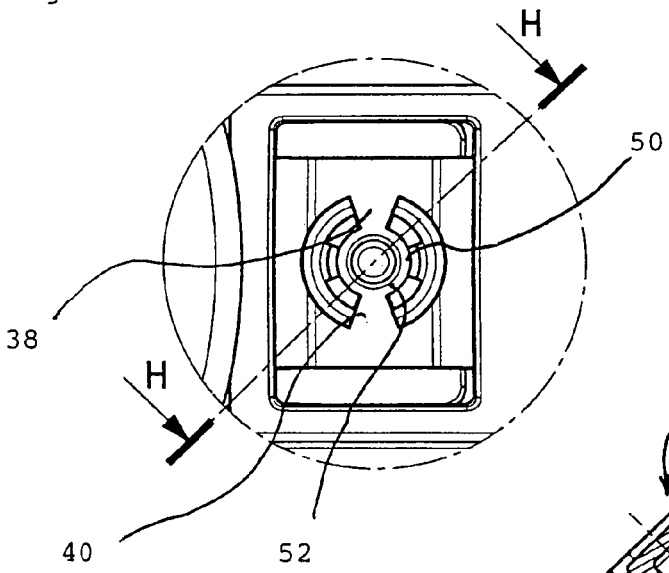
FIG. 4 a view to show the closure elements of the embodiment according to FIGS. 1 to 3.

FIG. 4 shows that there are two webs 38 and 40 extending towards the flat portion 50. The stiffness and size of webs 38 and 40 define the force which is required to press down closure element 34 to the temper-evident position, and also to keep closure element 34 in the intermediate position as shown in FIGS. 2 and 3.

Figure 5:
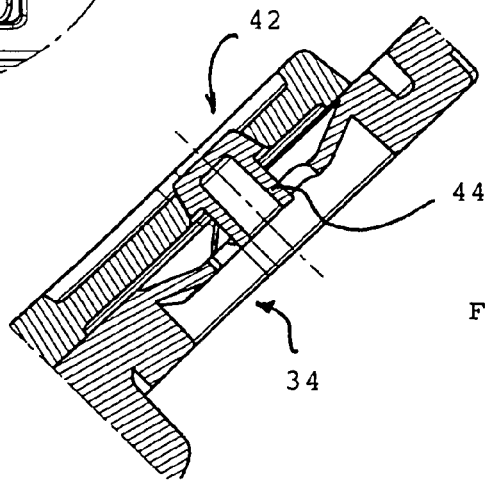
FIG. 5 a sectional view of a detail of a container in another embodiment of the invention.

FIG. 5 corresponds to the embodiment shown in FIGS. 2 to 4 but the opening 42 and closure element 34 are exchanged with respect to their position on the closure cap 14 and the container body 12 respectively.

Figure 6:
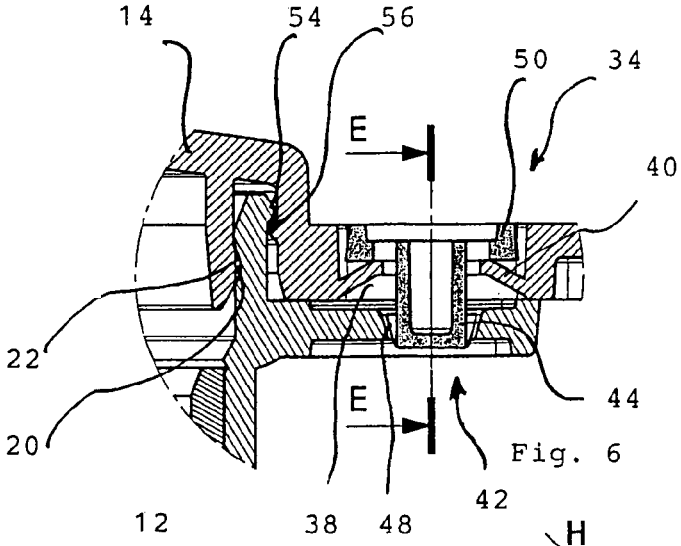
FIG. 6 a sectional view of third embodiment of the container, corresponding to FIG. 2.
Figure 7:
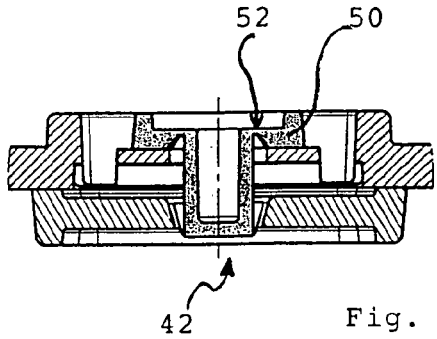
FIG. 7 a sectional view of the safety element, taken along the line EE of FIG. 6.
Figure 8:
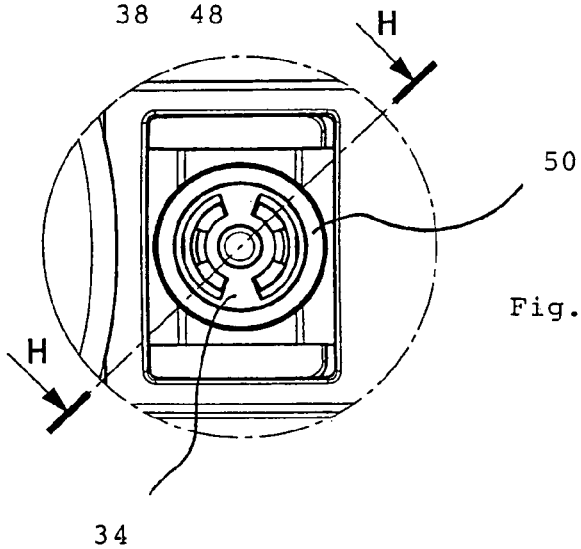
FIG. 8 a view to show the closure element of the embodiment according to FIGS. 6 and 7.

Another embodiment may be taken from FIGS. 6 to 8. Contrary to the previous embodiments, in this case closure element 34 is manufactured as a separate piece which again has a flat portion 50 and a cylindrical portion 44. It is held in the intermediate position according to FIG. 6 by the webs 38 and 40 but may be pressed down into the temper-evident position in a single stroke if desired. In this position, the webs 38 and 40 are urged down-wards and the wedge-shaped protrusion 48 will form a shoulder against the lower edge of opening 42 such that the closure element 34 and the webs 38 and 40 are held down.

FIG. 7 again shows the film hinge 52 being formed between flat portion 50 and cylindrical portion 44. If film hinge 52 is destroyed, the flat portion 50 will lose any contact with the remainder of the container 10 and will get lost such that any user may immediately take notice that the element has been broken.

FIG. 8 shows that the flat portion 50 of closure element 34 is essentially a ring. It is made of red plastic material.

Further details are evident from the enclosed drawings. In fact, the containers 10 shown with the embodiments of the present invention have a double seal. Beyond the seal between protrusions 20 and 22, there are shoulders 54 and 56 interacting in the closed condition of the cap 14 on the container body 12, between the rim 18 of the container body 12 and an inner surface of cap 14.

Figure 9:
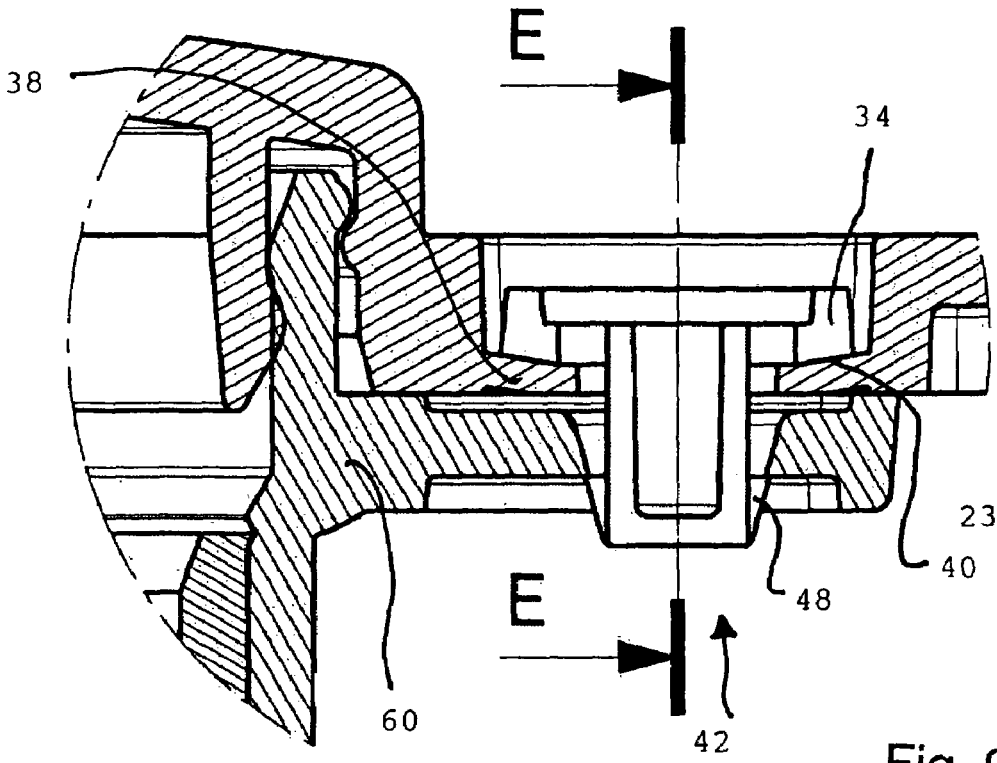
FIG. 9 a sectional view of the embodiment according to FIG. 6 but in the temper-evident position of the closure element.

FIG. 9 shows the embodiment of FIG. 6, but in the temper-evident position of closure element 34. Obviously, the webs 38 and 40 are pressed down, and the wedge-shaped protrusion 48 interact with the portion of the flange 60 surrounding opening 42. Although FIGS. 9 to 12 show the wedge-shaped protrusion to only slightly overlap opening 42, due to the elasticity of the material used for closure element 34, a larger overlap might be desired. The opening 42 has a conical shape which is in consistency with the frustoconical shape of protrusion 48.

As soon as the wedge 48 snaps into the opening 42 the webs 38 and 40 are fixedly held down against their resilient force, and the container 10 is in the temper-evident state.

Figure 10:
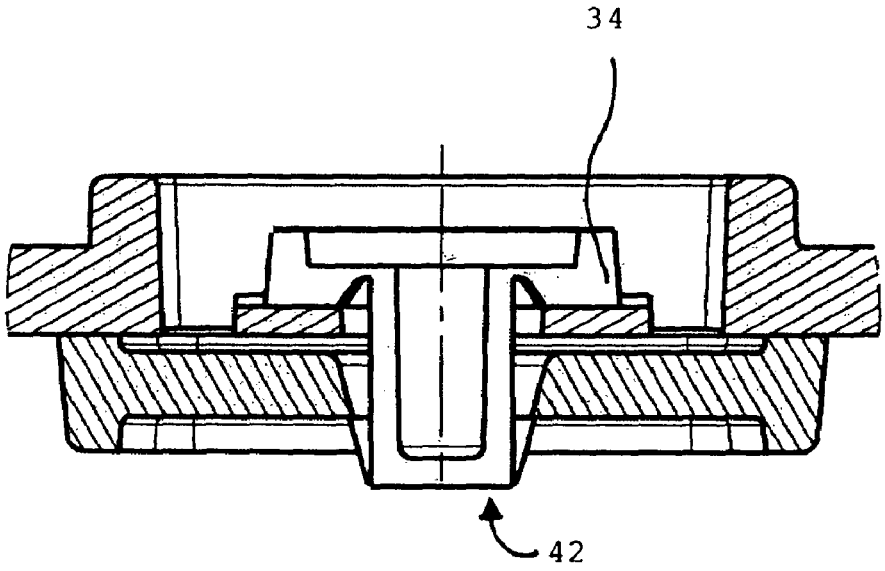
FIG. 10 a view of the embodiment according to FIG. 7, but in the temper-evident position of the closure element.
Figure 11:
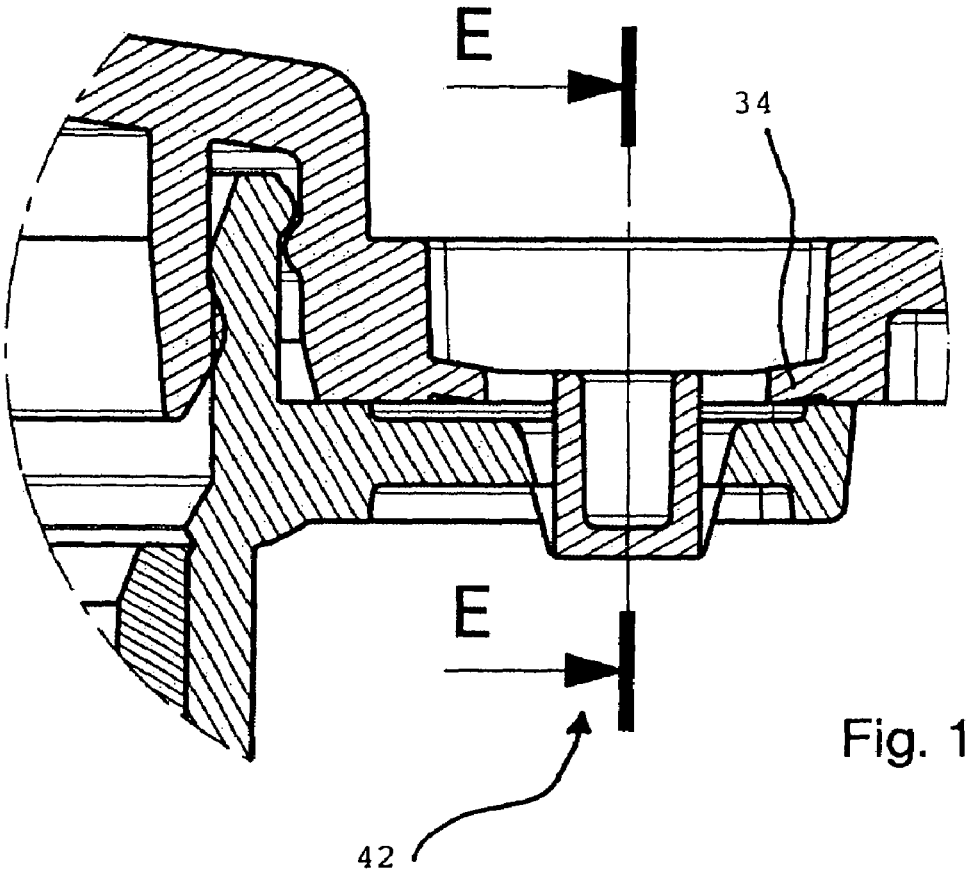
FIG. 11 a sectional view of the embodiment according to FIG. 2 but in the temper-evident position of the closure element.
Figure 12:
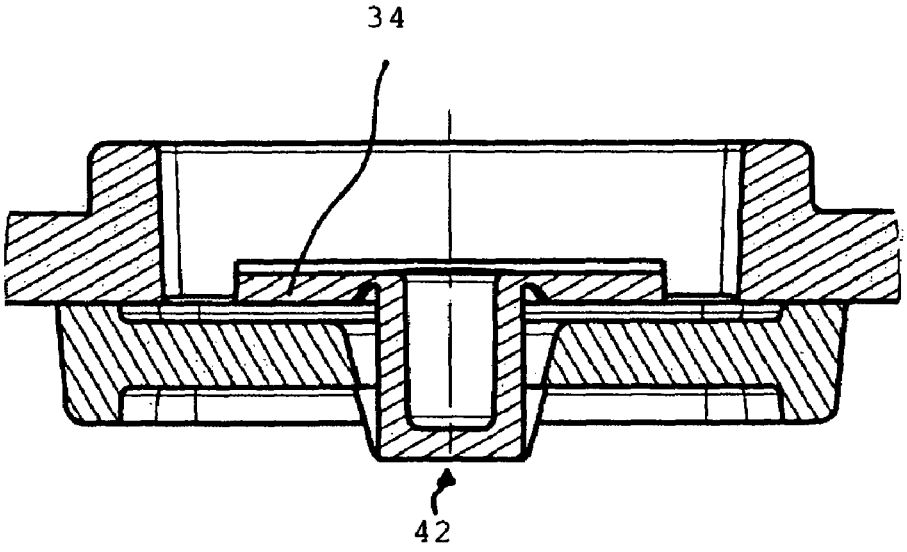
FIG. 12 a view of the embodiment according to FIG. 3, but in the temper-evident position of the closure element.

FIG. 10 shows this state of the closure element 43 in another view and FIGS. 11 and 12 show the respective state of closure element 34 in the embodiment shown in FIGS. 2 and 3.

What is claimed is:

1. Container assembly having a container body and a closure cap, the container body has a rim and an opening (42) which is provided laterally of the container body (12); and the closure cap is hinged to the container body and is movable from an open position to an intermediate position where it engages the rim of the container; said container assembly further comprising:

a closure element (34) carried by the closure cap, wherein the closure element is movable to a tamper-evident position to fully close said container assembly when the closure cap is initially in the intermediate position, the closure element (34) comprising a cylindrical portion (44) which may be pressed into the opening (42) of the container body, and a flat portion (50), wherein the cylindrical portion and the flat portion are interconnected to each other via a film hinge (52) which is formed as a very thin connection which easily tears if a force is exerted to open the closure cap from its fully closed position, the cylindrical portion (44) remaining in the opening (42) when opening the closure cap from the fully closed position, and wherein the flat portion (50) is mounted via webs (38,40) to the closure cap (34), wherein said webs initially bias the closure element (34) to the intermediate position and away from the tamper-evident position.

2. Container assembly according to claim 1, characterized in that the closure element (34) is biased toward its intermediate position by said webs and its held down in the temper-evident position by interactive engagement between a locking element (48) formed on said cylindrical portion, and a shoulder formed on the container body (12).

3. Container assembly as set forth in claim 1, wherein the container body (12) has a generally cylindrical sidewall, and a desiccant (30) adjacent a container sidewall.

* * * * *